US007949276B2

(12) United States Patent
Morikawa et al.

(10) Patent No.: US 7,949,276 B2
(45) Date of Patent: May 24, 2011

(54) IMAGE FORMATION APPARATUS AND ASSOCIATED METHODOLOGY FOR PATCH IMAGE FREQUENCY UPDATING

(75) Inventors: Haruki Morikawa, Miyagi (JP); Ayako Shimadu, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 753 days.

(21) Appl. No.: 11/766,400

(22) Filed: Jun. 21, 2007

(65) Prior Publication Data

US 2008/0008485 A1 Jan. 10, 2008

(30) Foreign Application Priority Data

Jul. 6, 2006 (JP) ..... 2006-186814

(51) Int. Cl.
*G03G 15/00* (2006.01)

(52) U.S. Cl. ..... 399/72

(58) Field of Classification Search ..... 399/49, 399/72

See application file for complete search history.

(56) References Cited

U.S. PATENT DOCUMENTS 5,471,313 A * 11/1995 Thieret et al. ..... 358/296
6,181,888 B1 * 1/2001 Scheuer et al. ..... 399/49

FOREIGN PATENT DOCUMENTS

JP 2001-125365 5/2001

* cited by examiner

*Primary Examiner* — David M Gray
*Assistant Examiner* — Gregory H Curran
(74) *Attorney, Agent, or Firm* — Oblon, Spivak, McClelland, Maier & Neustadt, L.L.P.

(57) ABSTRACT

An apparatus and method to update patch image formation frequency, in which an electrostatic latent image is formed on an image supporting object, and the electrostatic latent image is developed with a toner. The image formation apparatus includes a developing unit, a toner supply unit for supplying the toner to the developing unit, a patch image density detecting unit for detecting the density of a patch image formed on the image supporting object, a toner density detecting unit for detecting the density of the toner held in the developing unit, and a control unit that adjusts a generating interval of the patch image according to a detection result of the patch image density detecting unit.

11 Claims, 7 Drawing Sheets

FIG.3

| Vsp/Vsg | <0.05 | 0.05～0.08 | 0.08～0.12 | 0.12～0.15 | 0.15< |
|---|---|---|---|---|---|
| N: GENERATING INTERVAL (SHEETS) | 1 | 5 | 10 | 5 | 1 |

IMAGE FORMATION APPARATUS AND ASSOCIATED METHODOLOGY FOR PATCH IMAGE FREQUENCY UPDATING

BACKGROUND OF THE INVENTION

1. Field of the Invention

The present invention generally relates to an image formation apparatus, and especially relates to density control of the image formation apparatus.

2. Description of the Related Art

In image formation apparatuses such as a printer, a copying machine, and a facsimile apparatus, a latent image is electrostatically formed on a photoconductor serving as an image supporting object, toner is applied to the latent image to obtain a toner image, the toner image is transferred to a transfer medium such as paper, and the transferred toner image is fixed for output.

For developing the latent image into the toner image, a two-component developer, wherein the toner is mixed with a carrier, is often used.

When developing, in order to obtain uniform density of images to be formed on the photoconductor, image density control for controlling the supply of the toner is performed such as described below.

According to a method (first conventional method), a "patch image" is formed on the photoconductor, the density of the patch image is measured by an image density sensor (P sensor), and toner supply is controlled according to a result of the image density measurement. Here, the patch image is a reference image having a reference density for the density measurement.

According to another method (second conventional method), toner density (content of the toner in the developer) is measured. Especially when the developer is made of the toner and a magnetic carrier, the toner density (content of the toner) is measured in terms of the permeability of the developer by a permeability sensor (T sensor). The supply control of the toner is performed according to the toner density measurement (for example, Patent Reference 1).

The first conventional method has a problem in that the patch image cannot be formed during image formation if a transfer belt and a transfer roller are used for image transfer wherein a transfer surface contacts the photoconductor. Further, when printing is continuously performed, the image density control using the patch image cannot be performed in the meantime; accordingly, even if the image density fluctuates, the image density cannot be corrected.

The second conventional method has a problem in that the image density control cannot follow a change of "development capability". If the development capability changes density of a resulting image changes. The change of the development capability can occur with degradation of the developer, a change of the environment, and a difference of development conditions of developers and apparatuses.

Then, a density control method combining the first and the second conventional methods is proposed as disclosed by Patent Reference 1 so that the problem of one is compensated for by the other.

According to the combined method, the toner density is controlled so that a toner density value (Vt) measured by the T sensor may be in agreement with a toner density reference value (Vtref). The toner density reference value (Vtref) is obtained by "a previous toner density value (Vt)−a compensation value (ΔVtref)". Here, the predetermined compensation value ΔVtref is obtained using an image density value (Vp) of the patch image, which Vp is equal to Vsp/Vsg (Vsp=detected electric potential, and Vsg=electric potential corresponding to background optical density). Then, the toner supply is controlled so that the Vt becomes equal to the toner density reference value Vtref.

With reference to FIG. 6 that is a flowchart representing the process described above, whether the number of sheets processed since the last P sensor detection reaches a predetermined value (e.g., 10 as shown in FIG. 6) is determined every time the copying process is completed. If the determination is affirmative (i.e., if the number of processed sheets reaches the predetermined value), the patch image is generated, and the P sensor detects the density (Vp=Vsp/Vsg) of the patch image.

In addition to the image density detection, the toner density is detected. Specifically, the T sensor detects a present Vt; the compensation value ΔVtref is determined based on the previous Vt, the present Vt, and Vsp/Vsg; and then, the Vtref is updated and stored.

The updated Vtref (to serve as the target value of the T sensor), and the difference (i.e., Vt−updated Vtref) for every one copy are obtained as described above; then, toner supply conditions for every copy (image formation) are determined.

However, when the copying process is performed for a greater number of sheets than the predetermined number, since the patch image cannot be formed until the process is completed, the image density control cannot be performed, so the toner density control is carried out based on the previous Vtref.

As described above, the problem of the second conventional method is compensated for by the P sensor, which problem is in that the image density control cannot follow the change of development capacity due to degradation of the developer, the change of the environment, and the difference of the development conditions of developers and apparatuses; the problem of the first method is compensated for by the T sensor so that the image density may be uniform, which problem is in that the patch image cannot be formed during image formation if the transfer belt and the transfer roller are used for image transfer wherein the transfer surface contacts to the photoconductor (e.g., Patent Reference 1).

[Patent Reference 1] JPA 2001-125365

DISCLOSURE OF INVENTION

Objective of Invention

However, the toner density control using the P sensor as described above has a problem in that proper density control cannot be performed if the amount of electrification of the developer fluctuates. The amount of electrification of the toner fluctuates with environmental changes, especially by discharging due to humidity and prolonged storage. For this reason, even if the toner supply control is successfully performed to obtain the desired toner density, toner adhesion to the image changes with the amount of electrification, and it is difficult to keep the proper density.

FIG. 7 is a graph showing the relationship between the toner density (TC) and the amount of electrification (Q/m). If the image formation apparatus is started when the amount of electrification is low, such as after prolonged non-operation, e.g., at night, the density control raises the toner density, and the detection value of the image density (Vp=VSp/Vsg) is determined to be high. For this reason, the toner density reference value (Vtref) that serves as the target value for the tone supply control is not changed. That is, even though the toner density actually is low, toner supply (supplement) is not carried out, and predetermined image density is not obtained.

Then, the image formation process is continued while there is no supplementary supply of the toner until the predetermined number of sheets has been processed. When processing the predetermined number of sheets is completed, the patch image is formed, the image density value (Vp) is detected, the density control is performed according to the Vp, and the image density gradually approaches the target density. This process is disclosed in Patent Reference 1.

However, since the density compensation after starting requires that the patch image be formed at predetermined intervals, only the toner supply control based on the previous compensation value is performed until the patch image is formed. For this reason, compensation for environmental fluctuation and change of the amount of electrification in the meantime is not available. That is, even when the amount of electrification changes due to the environmental fluctuation and prolonged time, the density compensation that follows the change may not be obtained.

Further, if a great number of sheets, for example, 500 to 1000, are processed without performing the density compensation according to change of the amount of electrification, since the patch image cannot be formed during the process, the toner density reference value Vtref at the time of starting is kept being used. That is, the control continues as if the density is high, the densities of the first half and the second half become different, and a copying result becomes degraded for the last part. As described, according to the conventional density control for the two-component developer, there is a possibility that image density fluctuation might occur due to change of the amount of electrification of the toner of the developer.

SUMMARY OF THE INVENTION

The present invention provides an image formation apparatus and an image formation method that substantially obviate one or more of the problems caused by the limitations and disadvantages of the related art.

Specifically, the present invention provides an image formation apparatus and an image formation method that are configured to maintain proper image density despite a sudden change of an amount of electrification of a toner.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by an image formation apparatus particularly pointed out in the specification in such full, clear, concise, and exact terms as to enable a person having ordinary skill in the art to practice the invention.

Means For Solving The Problem (1) To achieve these solutions and in accordance with an aspect of the invention, as embodied and broadly described herein, an embodiment of the invention provides an image formation apparatus, wherein an electrostatic latent image is formed on an image supporting object, and the electrostatic latent image is developed (made visible) with a toner, which image formation apparatus includes a developing unit, a toner supply unit for supplying the toner to the developing unit, a patch image density detecting unit for detecting the density of a patch image formed on the image supporting object, a toner density detecting unit for detecting the density of the toner held in the developing unit, and a control unit connected to the patch image density detecting unit and the toner density detecting unit on an input side of the control unit, and connected to the toner supply unit on an output side of the control unit, wherein the control unit is capable of adjusting a generating interval of the patch image according to a detection result of the patch image density detecting unit when controlling an operation of the toner supply unit in order to adjust the toner density of the developing unit so that an image density value of the patch image detected by the patch image density detecting unit may become equal to a predetermined target density value.

(2) According to another aspect of the embodiment, the control unit decreases (shortens) the generating interval of the patch image if the image density value detected by the patch image density detecting unit is not equal to the predetermined target density value.

(3) According to another aspect of the embodiment, a counter unit is connected on the input side of the control unit, which counter unit is for counting the number of times of image formation (number of times of printing). Then, if the counted number is greater than a predetermined value, the patch image can be formed during image formation.

Effectiveness of Invention

According to the embodiment of the present invention, the image density following the fluctuation of the amount of electrification is realized by changing the generating interval of the patch image. Since the density control using the patch image can be performed during image formation (without waiting for the processing of the predetermined number of sheets to have been completed), a timely adjustment of the image density is attained when the amount of electrification fluctuates. Accordingly, even if a great number of copying processes are performed since the density adjustment opportunity has taken place, the image density can be made uniform for the first sheet through the last image.

BRIEF DESCRIPTION OF THE DRAWINGS

FIG. 3 is a table for providing a generating interval in association with a difference between an image density value and a target density value;

DESCRIPTION OF THE PREFERRED EMBODIMENTS

In the following, embodiments of the present invention are described with reference to the accompanying drawings.

Figure 1:
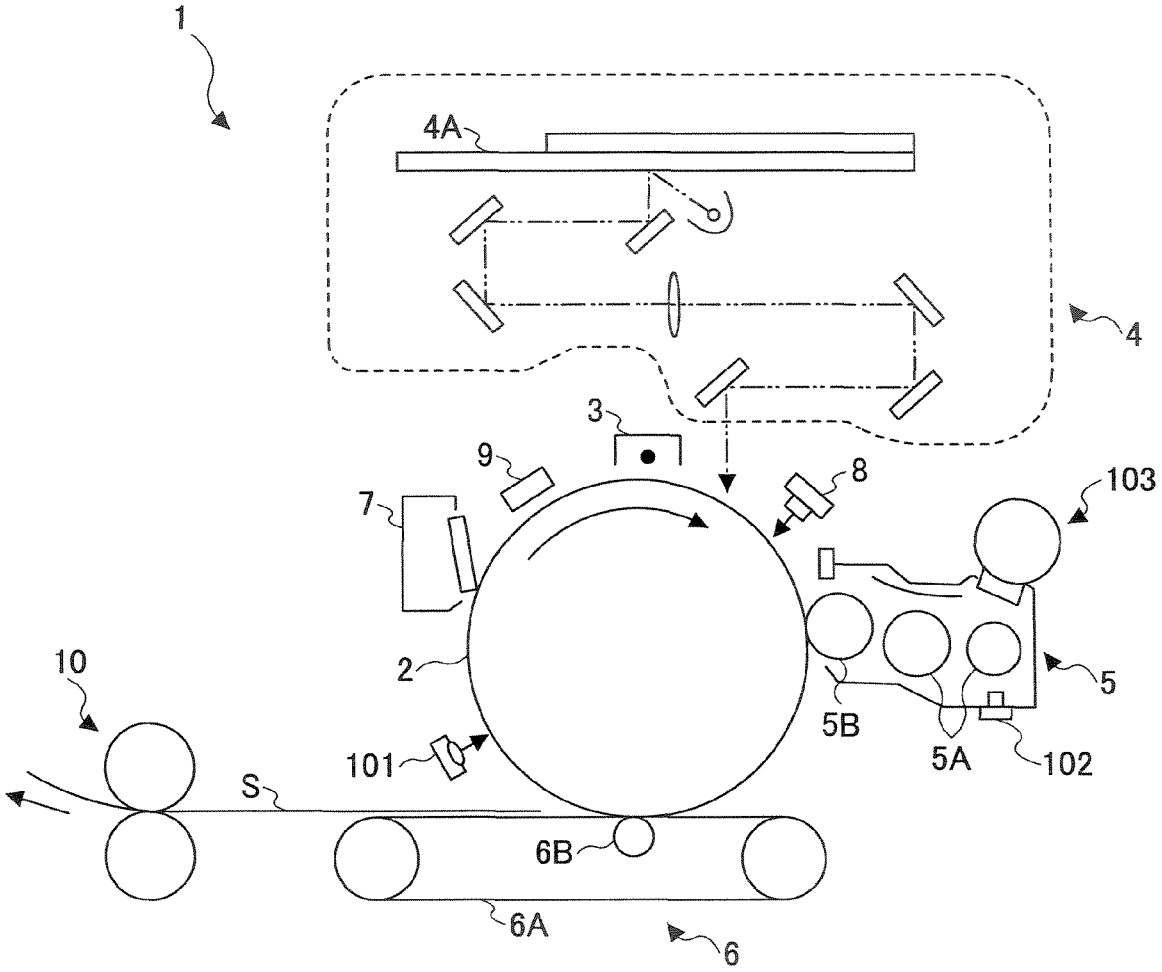
FIG. 1 is a schematic diagram of an example of an image formation apparatus according to an embodiment of the present invention.

FIG. 1 is a schematic diagram of an example of the image formation apparatus 1 according to an embodiment of the present invention. Although the image formation apparatus shown in FIG. 1 is a copying machine, it is for example only. That is, the image formation apparatus of the embodiment of the present invention is not limited to the copying machine, but may be a printer, a facsimile apparatus, and a copier, wherein an electrostatic latent image is formed on a photoconductor that serves as an image supporting object by irradiating a laser light to scan a manuscript at timing according to image information.

The image formation apparatus 1 includes a photoconductor 2 that is shaped like a drum, is rotated, and serves as the image supporting object. Around the photoconductor 2, the following units are sequentially arranged in a direction of an arrow for performing an image formation process; namely, an electrification unit 3, a writing unit 4, a developing unit 5, a transfer unit 6, and a cleaning unit 7. Further, an eraser 8 is arranged for reducing background optical density before development so that background dirt may be reduced, and an electrification removing unit 9 is arranged for removing residual charge (electrification) of the photoconductor 2.

The electrification unit 3 is a non-contacting type electrification unit such as a corona charger. The writing unit 4 is configured such that an electrostatic latent image may be formed by an exposure light irradiated to the photo conductor 2 through a lens and two or more mirrors, which exposure light is obtained by irradiating the laser light onto the manuscript placed on a manuscript placing table 4A.

Further, the developing unit 5 uses a two-component developer made of the toner and a carrier. The developing unit 5 includes a stir-mixing roller 5A that is rotated such that the toner that is friction-charged may be adhered to the carrier to constitute the developer. The developing unit 5 further includes a development sleeve 5B that counters the photoconductor 2 for supplying the toner/developer to the photoconductor 2 so that the electrostatic latent image on the photoconductor 2 may be developed to be visible.

The transfer unit 6 includes a transfer belt 6A that counters and contacts the photo conductor 2, and a transfer roller 6B that counters the photo conductor 2 for providing transfer bias.

According to the image formation apparatus 1 as described above, the electrostatic latent image is formed by the writing unit 4 on the photoconductor 2 that is uniformly charged (electrified) by the electrification unit 3, and the electrostatic latent image is developed by the toner of the developer supplied by the developing unit 5. The developing unit 5 includes a toner supply unit 103, and supply of the toner is controlled by the control unit 100 as described below.

The toner image that has been made visible is transferred to a recording medium S such as a sheet of paper that is fed by a feeding apparatus (not illustrated) using the transfer bias provided by the transfer roller 6B of the transfer unit 6. After the toner image is transferred, the toner image is thermally fixed to the recording medium S by a fixing apparatus 10.

Figure 2:
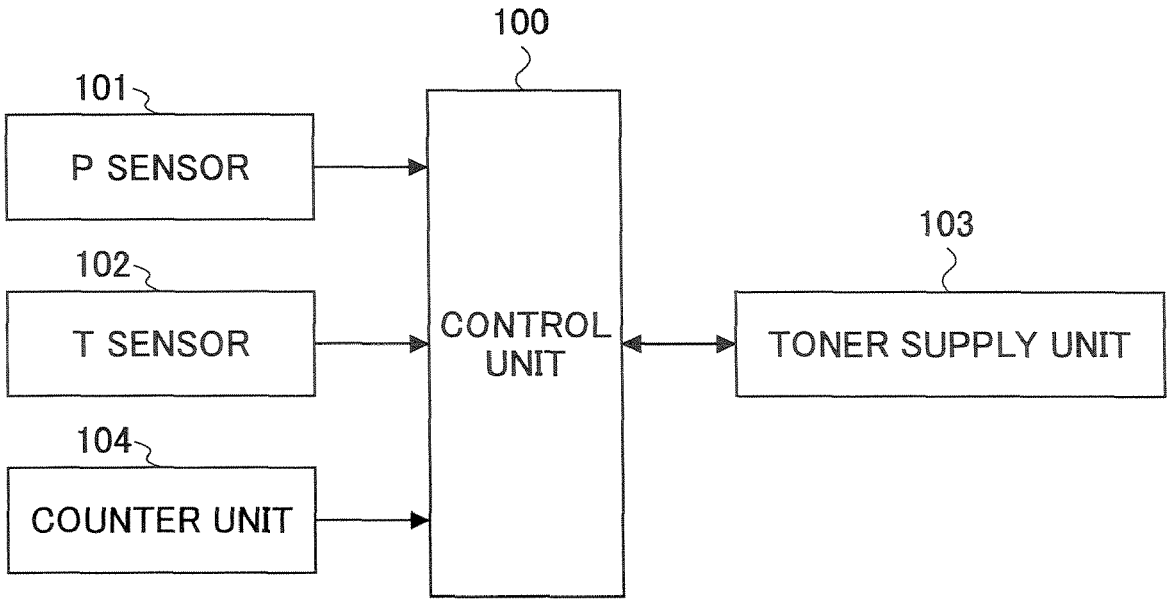
FIG. 2 is a block diagram of a control unit of the image formation apparatus shown in FIG. 1.

Further, the image formation apparatus 1 includes an image density detection sensor (P sensor) 101, which is an optical sensor for detecting the density of the image formed on the photoconductor 2, and a toner density sensor (T sensor) 102 for detecting the density of the toner held in the developing unit 5 using a permeability detection method. The P sensor and the T sensor are connected to the input side of the control unit 100 as shown in FIG. 2. Further, a counter unit 104 is connected to the input side of the control unit 100.

The control unit 100 controls detection of image density of the patch image having a reference density, which patch image is formed separately from an image to be printed. In order to obtain proper image density according to a detection result, the control unit 100 controls operations of the toner supply unit 103 of the developing unit 5. Accordingly, the toner supply unit 103 is connected to the output side of the control unit 100. A specific target of the toner supply unit 103 to be controlled may be a driving source of a member that supplies the toner held in a toner storage tank.

Next, operations of the control unit 100 are described.

Operation (1): The generating interval of the patch image (that has the reference density) is adjusted according to the image density value (Vp=Vsp/Vsg) detected by the image density detection sensor 101.

Operation (2): Specifically, if the image density value is not equal to a target value, the generating interval of the patch image is reduced (shortened).

Operation (3): If the image density value (Vp=Vsp/Vsg) is out of a predetermined range, and if a greater number of sheets than a predetermined value is processed, the patch image is formed even if an image is being formed.

The operations of the control unit 100 are further described.

Generally, toner density control is for adjusting the toner density reference value (Vtref) that serves as the target toner density according to the image density detection result of the patch image, and for controlling supply of the toner so that the toner density may be in agreement with the adjusted toner density reference value.

Although the embodiment of the present invention employs this approach, the embodiment further provides a solution for the problem wherein the amount of electrification of the developer is low, the same image density value is continuously used, and proper image density cannot be maintained.

Specifically, concerning the operation (1) above, it is considered that a fluctuation of the amount of electrification occurs when starting the image formation apparatus, and when a predetermined number of sheets have been processed. If at least one of these conditions is met, the image density detection sensor 101 detects the density of the patch image. If the image density value (Vp) detected is out of a predetermined range, e.g., between 0.08 and 0.12, the generating interval of the patch image is changed, and the changed generating interval is stored in a storage unit.

Further, the toner density of the developing unit 5 is detected, the compensation value (ΔVtref) for obtaining the target toner density value is computed based on the toner density value (Vt) and the image density value (Vp) at the present time, and the compensation value (ΔVtref) is updated from the previous compensation value to the computed compensation value. Here, the toner density reference value (Vtref) has been acquired through experiments, and the like, and is stored in the control unit 100 as mapped data.

When an image density value (Vp) that serves as the target of the image density sensor 101 is determined, supply conditions of the toner are arranged in a direction that cancels the difference between the toner density reference value (Vtref) and the tone density value (Vt) detected by the toner density sensor 102 for every one copy. Then, the toner supply unit 103 operates under the supply conditions.

Figure 6:
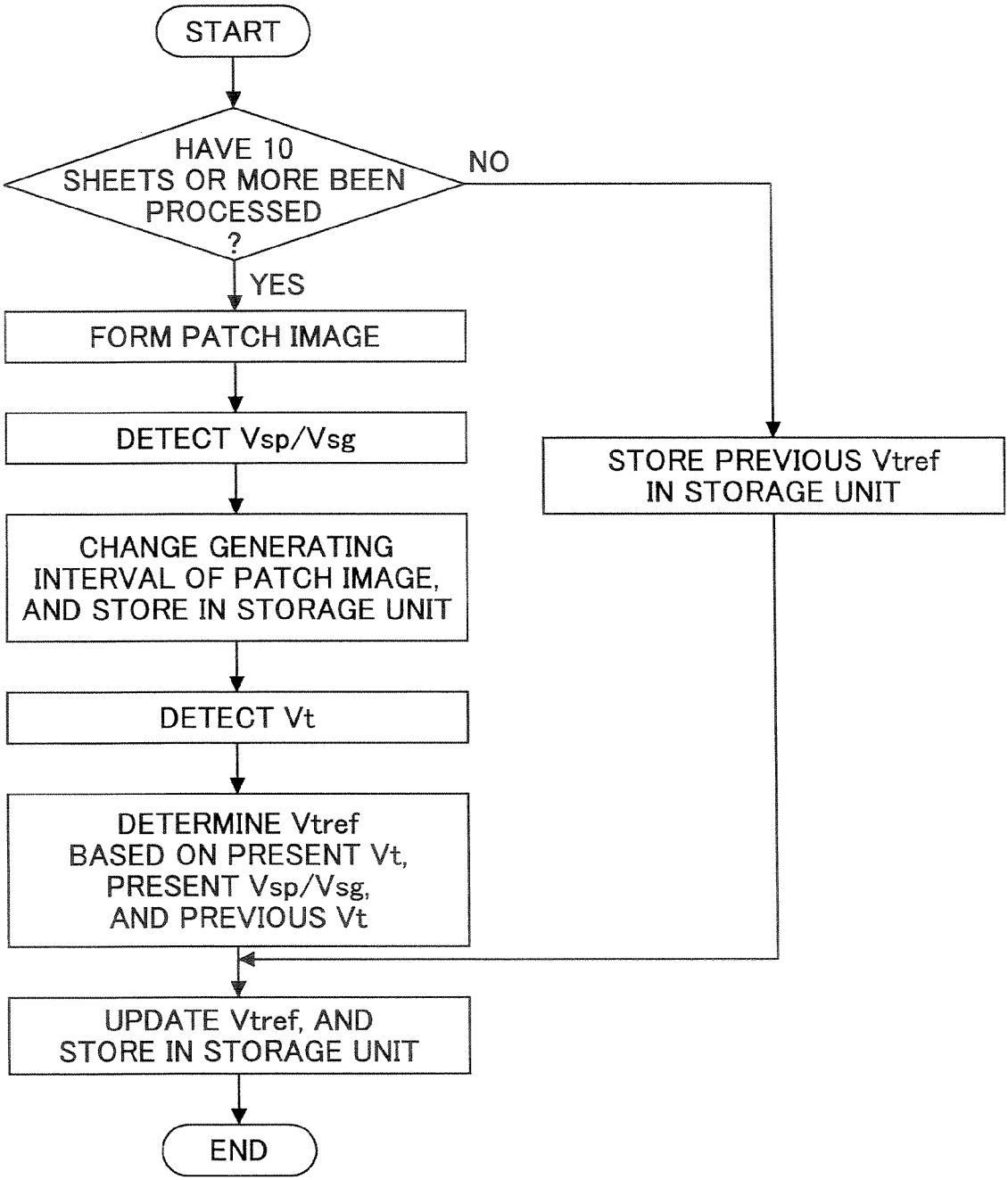
FIG. 6 is a flowchart of an operation of conventional image density control.
Figure 7:
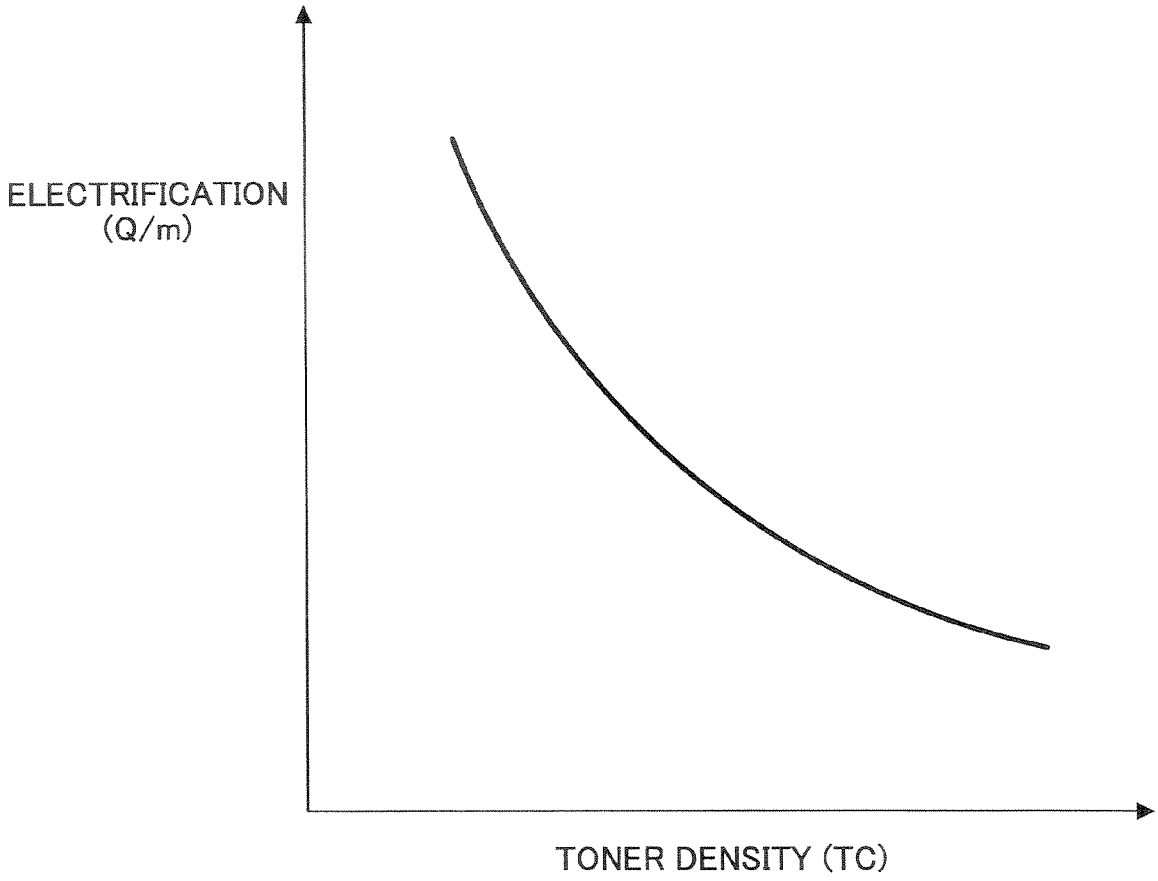
FIG. 7 is a graph showing a relationship between the amount of electrification and the toner density of the developer.

By the operations as described above, the generating interval of the patch image can be adjusted according to the fluctuation of the amount of electrification, that is, the compensation of the toner density is performed following the fluctuation of the amount of electrification. This is in addition to the control shown in FIG. 6, wherein the control takes place only when the number of sheets processed reaches the predetermined value.

Next, the operation (2) is described.

The generating interval of the patch image is reduced if the image density value (Vp) acquired at the present time is out of the predetermined range, e.g., between 0.08 and 0.12. FIG. 3 is a table showing correspondence between errors of the image density value (Vp) at the present time and the generating interval of the patch image. Here, the errors are differences between the image density value (Vp) and the target image density value. As shown in FIG. 3, the generating interval is shortened according to the magnitude of the errors. In this way, the image density value (Vp) is swiftly made to fall into the predetermined range.

Next, the operation (3) is described.

In contrast to the operations (1) and (2) described above, according to the operation (3), the generating interval of the patch image is reduced while continuously processing a great number of sheets so that the density compensation can be carried out and the image density in the beginning and in the last part may be the same.

That is, the control unit 100 performs the compensation control of the toner density so that the toner density reference value (Vtref) may be adjusted based on the toner density value (Vt) and the image density value (Vp) at the present time, and so that the toner density value (Vt) may be in agreement with the updated toner density reference value (Vtref) In addition to this, according to the operation (3), the patch image is formed if the image density value (Vp) becomes different from the target value before the number of times of image formation processes exceeds the predetermined value if the number of times of image formation processes is greater than a predetermined value.

In this way, regardless of the number of the image formation processes, the density control is performed during the image formation processes based on comparison of the image density value with the target value so that the image density is made uniform from the beginning to the last when the great number of sheets is processed.

In addition, the patch image may be formed not only when the image density value (Vp) becomes different from the target value, but also every time a desired predetermined number of sheets is processed.

Figure 4:
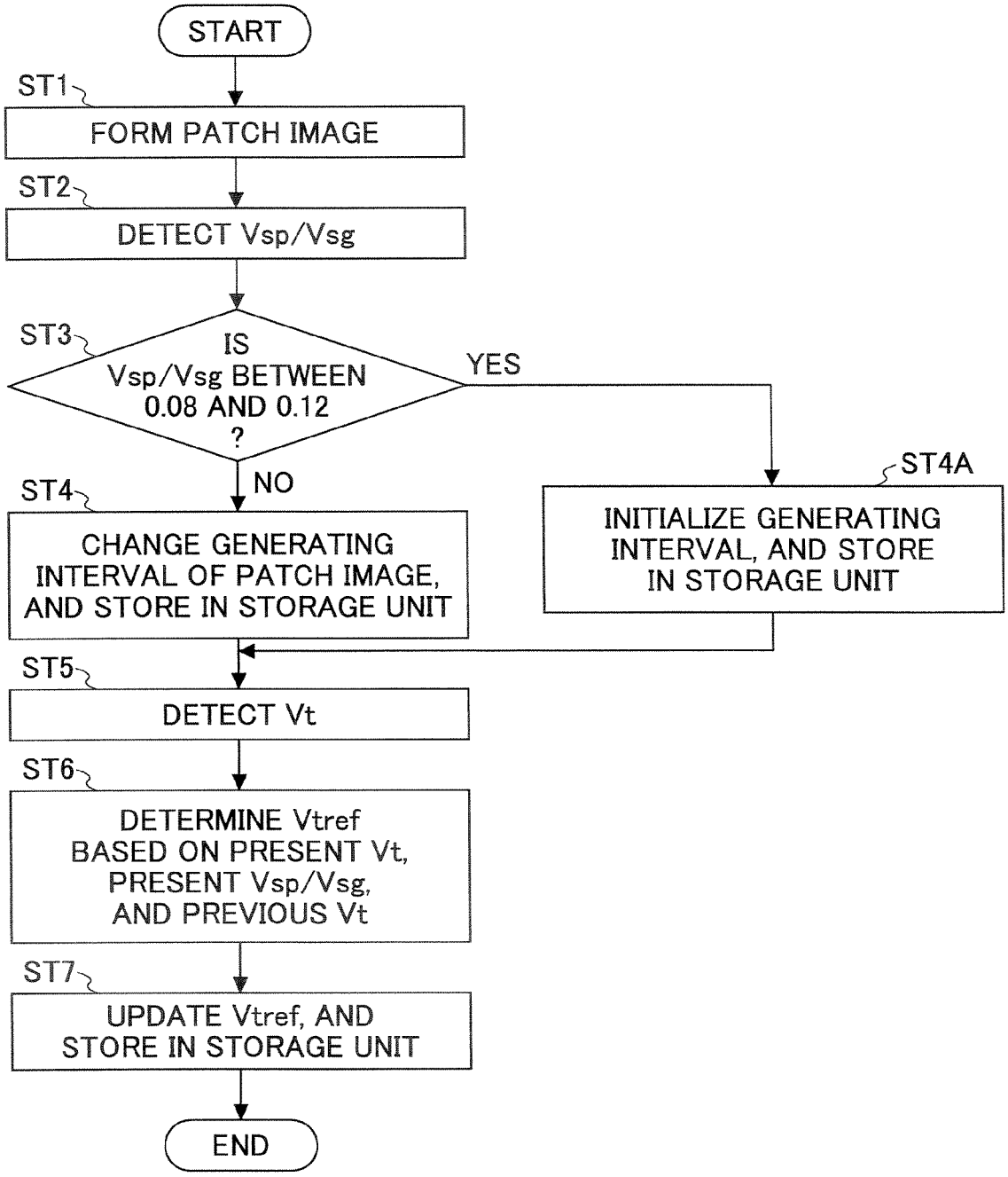
FIG. 4 is a flowchart of an operation of the control unit shown in FIG. 2.
Figure 5:
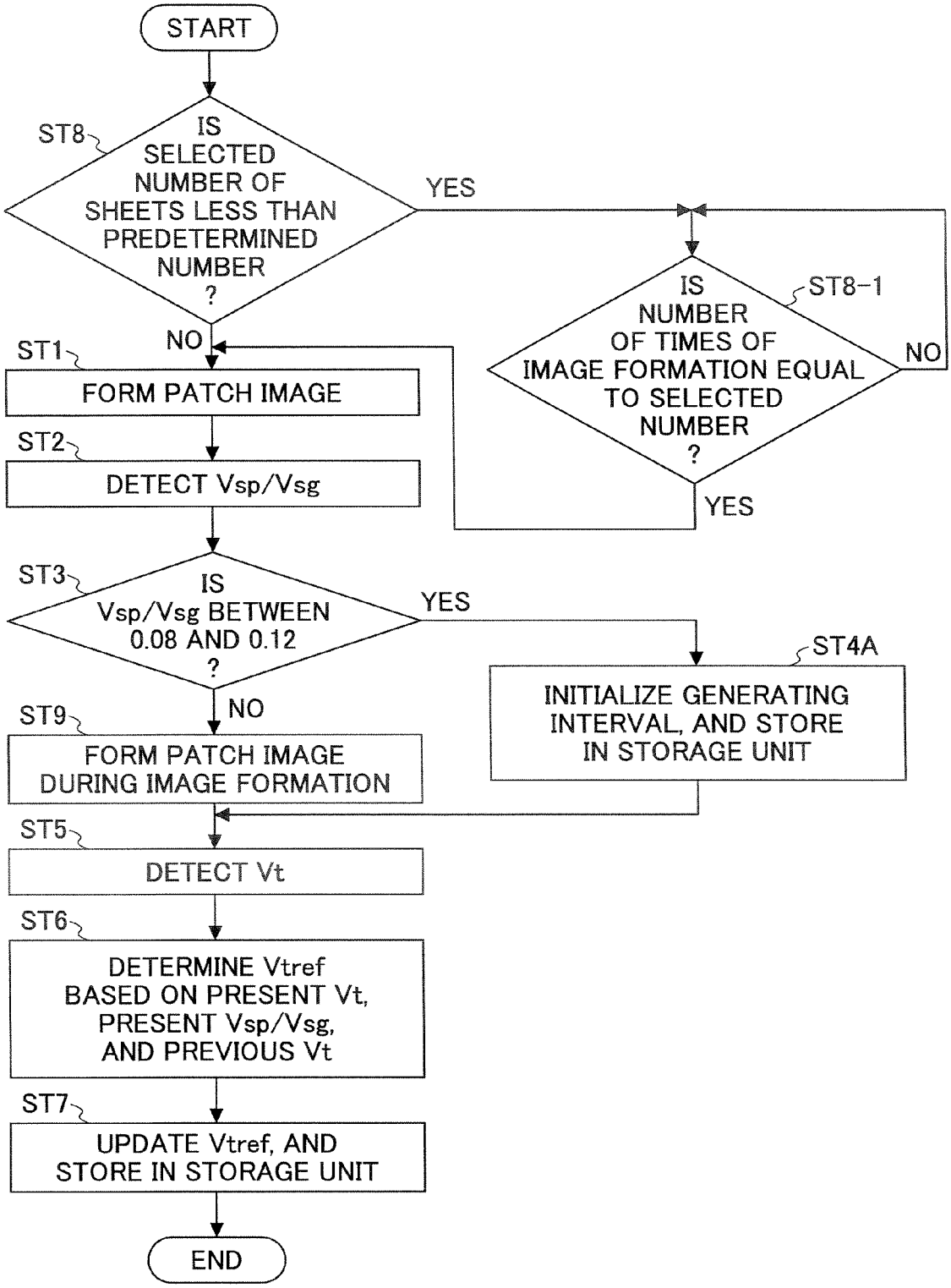
FIG. 5 is a flowchart of another operation of the control unit shown in FIG. 2.

FIGS. 4 and 5 are flowcharts showing the operations described above.

FIG. 4 shows the operations (1) and (2). The patch image is formed at the time of starting the image formation apparatus (ST1). The image density detection sensor 101 detects the density, and computes the image density value (Vp=Vsp/Vsg) at the present time (ST2).

Then, the computed image density value (Vp) is compared with the target (ST3). If the Vp is out of the predetermined range, the generating interval of the patch image is adjusted, and information about the updated generating interval is stored in the storage unit (ST4). The generating interval is adjusted according to the magnitude of the difference from the predetermined range as shown in FIG. 3; that is, the greater the difference is, the smaller the generating interval is made.

Whether the generating interval of the patch image is changed or not, the toner density sensor 102 detects the toner density in addition to the image density. The toner density value (Vt) is acquired. The compensation value (ΔVtref) for the toner density value that serves as the target is obtained from the previous detection values (Vp and Vt) and the present detection values (Vp and Vt), and the toner density value (Vtref) is updated with the compensation value (ΔVtref). Then, the updated Vtref is stored in the storage unit (ST5 through ST7).

The control unit 100 performs drive control of the toner supply unit 103 for controlling the supply of the toner such that the toner density value may be in agreement with the target toner density value determined at step ST7. If the image density value (Vp=Vsp/Vsg) of the patch image obtained by the image density detection sensor 101 falls within the predetermined range, the generating interval of the patch image is returned to the initial value (10 in this example) (ST4A).

FIG. 5 is a flowchart of the operation (3). According to the operation (3), it is determined whether a selected number of sheets is less than the predetermined number (10 in this example) (ST8). Here, the "selected number of sheets" is the number of sheets to be processed. If it is determined that the selected number of sheets is less than the predetermined number, the steps shown in FIG. 4 are performed.

If it is determined that the selected number exceeds the predetermined number of sheets at step ST8, steps ST1 through ST3 (the same as shown in FIG. 4) are performed. If the image density value (Vp) is out of the predetermined range (N at ST3), the patch image is formed even if the image formation of the predetermined number of sheets is not completed (ST9). In addition, at step ST8-1 in FIG. 5, timing for forming the patch image is determined in the case where the selected number of sheets is below the predetermined number of sheets. In addition, step ST4A in FIG. 5 is the same process as FIG. 4.

The toner density when forming the patch image at step ST9 is detected by the toner density sensor 102 and a toner density value (Vt) is acquired (ST5). Then, the same process as steps ST6 and ST7 shown in FIG. 4 are performed, and the toner supply control is carried out.

Further, the present invention is not limited to these embodiments, but variations and modifications may be made without departing from the scope of the present invention.

The present application is based on Japanese Priority Application No. 186814 filed on Jul. 6, 2006 with the Japanese Patent Office, the entire contents of which are hereby incorporated by reference.

What is claimed is:

1. An image formation apparatus to form an electrostatic latent image on an image supporting object, the electrostatic latent image being developed with a toner, the image formation apparatus comprising:

a developing unit;

a toner supply unit to supply the toner to the developing unit;

a patch image density detecting unit to detect a density of a patch image formed on the image supporting object;

a toner density detecting unit to detect a density of the toner held in the developing unit; and a control unit configured to determine an amount of difference between the density of the patch image and a predetermined target density value, and to select one of a plurality of generating intervals for formation of the patch image based upon a comparison between the amount of difference and a corresponding one of a plurality of ranges of difference between the density of the patch image and the predetermined target density value, so that an image density value converges to the predetermined target density value.

2. The image formation apparatus as claimed in claim 1, wherein the control unit varies the generating interval for formation of the patch image when the density of the patch image is not equal to the predetermined target density value.

3. The image formation apparatus as claimed in claim 1, further comprising:

a counter unit that counts a number of times of image formation, wherein when the counted number is greater than a predetermined value, the patch image is formed during image formation.

4. The image formation apparatus as claimed in claim 1, wherein the control unit is further configured to determine a selected number of sheets to be generated in an image formation operation, compare the selected number of sheets to the predetermined number to produce a comparison result, and form a patch image during image formation based upon the comparison result and the amount of difference between the detected density of the patch image and the predetermined target density.

5. The image formation apparatus as claimed in claim 1, wherein the plurality of ranges of difference between the density of the patch image and the predetermined target density value include at least five ranges of difference.

6. An image formation apparatus for forming an electrostatic latent image, the electrostatic latent image being is developed with a toner, the image formation apparatus comprising:

means for supporting an electrostatic charge;

means for developing the electrostatic latent image;

means for supplying the toner to the developing means;

means for detecting a density of a patch image formed on the image supporting means;

means for detecting density of the toner, as held in the means for developing;

means for determining an amount of difference between the density of the patch image and a predetermined target density value; and means for selecting one of a plurality of generating intervals for formation of the patch image based upon a comparison between the amount of difference and a corresponding one of a plurality of ranges of difference between the density of the patch image and the predetermined target density value, so that an image density value converges to the predetermined target density value.

7. The image formation apparatus as claimed in claim 6, wherein the means for selecting varies the generating interval for formation of the patch image when the density of the patch image is not equal to the predetermined target density value.

8. The image formation apparatus as claimed in claim 6, further comprising:

means for counting a number of times of image formation, wherein when the counted number is greater than a predetermined value, the patch image is formed during image formation.

9. An image formation method for an image formation apparatus for forming an electrostatic latent image on an image supporting object which is developed with a toner, the image formation method comprising:

developing the electrostatic toner image;

supplying the toner from a storage;

detecting a density of a patch image formed on the image supporting object;

detecting density of the toner, as held in the storage;

determining an amount of difference between the density of the patch image and a predetermined target density value; and selecting one of a plurality of generating intervals for formation of the patch image based upon a comparison between the amount of difference and a corresponding one of a plurality of ranges of difference between the density of the patch image and the predetermined target density value, so that an image density value converges to the predetermined target density value.

10. The image formation method as claimed in claim 9, wherein the selecting increases the generating interval for formation of the patch image when the density of the patch image is not equal to the predetermined target density.

11. The image formation method as claimed in claim 9, comprising:

counting a number of times of image formation, wherein when the counted number is greater than a predetermined value, the patch image is formed during image formation.

* * * * *